US012220014B2

(12) United States Patent
Hvesser et al.

(10) Patent No.: US 12,220,014 B2
(45) Date of Patent: Feb. 11, 2025

(54) HELMET

(71) Applicant: NFM AS, Ski (NO)

(72) Inventors: Thomas Hvesser, Båstad (NO); Michael Lach, Gdansk (PL)

(73) Assignee: NFM AS, Ski (NO)

( * ) Notice: Subject to any disclaimer, the term of this patent is extended or adjusted under 35 U.S.C. 154(b) by 169 days.

(21) Appl. No.: 17/775,128

(22) PCT Filed: Nov. 10, 2020

(86) PCT No.: PCT/EP2020/081625
§ 371 (c)(1),
(2) Date: May 6, 2022

(87) PCT Pub. No.: WO2021/099183
PCT Pub. Date: May 27, 2021

(65) Prior Publication Data

US 2022/0378139 A1 Dec. 1, 2022

(30) Foreign Application Priority Data

Nov. 18, 2019 (NO) ..... 20191369

(51) Int. Cl.
*A42B 3/04* (2006.01)

(52) U.S. Cl.
CPC ..... *A42B 3/0406* (2013.01)

(58) Field of Classification Search
CPC ..... A42B 3/0413; A42B 3/062; A42B 3/063; A42B 3/065
USPC ..... 2/422
See application file for complete search history.

(56) References Cited

U.S. PATENT DOCUMENTS

| | | | | | |
|---|---|---|---|---|---|
| 3,153,792 | A * | 10/1964 | Marietta | A42B 3/127 | 2/414 |
| 3,872,511 | A * | 3/1975 | Nichols | A42B 3/121 | 267/114 |
| 5,477,563 | A * | 12/1995 | Gentes | B29C 70/70 | 2/425 |
| 11,229,254 | B1 * | 1/2022 | Matteucci | A42B 3/063 | |
| 11,766,085 | B2 * | 9/2023 | Weber | A42B 3/125 | 2/414 |
| 2007/0125295 | A1 | 6/2007 | Sanguinetti | | |

(Continued)

FOREIGN PATENT DOCUMENTS

| | | | |
|---|---|---|---|
| DE | 3112924 | A1 | 10/1982 |
| EP | 2147606 | A1 | 1/2010 |

(Continued)

OTHER PUBLICATIONS

Guisan, Thierry; International Search Report; PCT/EP2020/081625; dated Feb. 3, 2021; 4 pages.

*Primary Examiner* — Timothy K Trieu
(74) *Attorney, Agent, or Firm* — Bradley Arant Boult Cummings

(57) ABSTRACT

A helmet attachment system (5, 31) comprising a helmet (1), a net (5) arranged on the helmet (1), and a helmet attachment arrangement (31). The helmet attachment arrangement (31) has a base layer (33) and an attachment layer (35). The attachment layer (35) is attached on one face of the base layer (33). The attachment layer (35) comprises a plurality of attachment layer sections (35*a*) that have a mutual distance and that define a string-receiving pattern (37) configured to receive strings (9) of said net (5).

14 Claims, 11 Drawing Sheets

(56) References Cited

U.S. PATENT DOCUMENTS

| | | | | |
|---|---|---|---|---|
| 2010/0229271 | A1 | 9/2010 | Marissen et al. | |
| 2012/0100309 | A1* | 4/2012 | Miyairi | H01J 37/3244 118/712 |
| 2013/0031700 | A1 | 2/2013 | Wacter et al. | |
| 2013/0174323 | A1 | 7/2013 | McFall | |
| 2017/0065018 | A1* | 3/2017 | Lindsay | A42B 3/067 |
| 2018/0192726 | A1* | 7/2018 | Chen | A42B 3/0406 |
| 2018/0360155 | A1* | 12/2018 | Jenkyn | A42B 3/121 |
| 2019/0142099 | A1* | 5/2019 | Lee | A42B 3/063 2/412 |

FOREIGN PATENT DOCUMENTS

| | | | |
|---|---|---|---|
| FR | 2895646 | A1 | 7/2007 |
| GB | 2474712 | A | 4/2011 |

* cited by examiner

HELMET

TECHNICAL FIELD

The present invention relates to a helmet and associated equipment, such as attachment systems for helmet-borne equipment.

BACKGROUND ART

Helmets have been known for a long time and come in various designs and configurations. Some helmets are designed for withstanding impacts. Some helmets, typically used by military personnel, are designed also with anti-ballistic function. While it was previously common to produce ballistic helmets with a metal layer, it is now common to produce a helmet main body in a lighter composite material. Typically, the main body of anti-ballistic helmets is made of a cured fiber reinforced composite, which provides a ballistic protection while having alight weight.

An example of an anti-ballistic helmet is given in publication US20100229271, where the main body comprises monolayers of unidirectional ultra-high molecular weight polyethylene fibers.

While the main object of helmets is to protect from impacts and in some cases to provide anti-ballistic function, helmets are also used to carry various types of equipment. Such equipment may include lights, cameras, communication devices, camouflage devices and more.

For attachment of such equipment, different systems are known. Some helmets comprise a net that spans across the external face of the helmet main body. Also known are patches that are glued to the external face of the helmet, which comprises one face of a hook-and-loop system, such as Velcro. Thus, to attach a device on the helmet, the device comprises a compatible face of the hook-and-loop system, so that the device can be easily attached and removed.

The company Core Survival (www.coresurvival.com) presents an attachment patch for helmets, where the patch itself is attached to a net on the helmet, while the equipment itself is connected to the batch with a hook-and-loop system (Velcro). In addition to the hook-and-loop system, the patch comprises an attachment string that secures the equipment, such as a light-source, to the patch.

Furthermore, in the front part of the helmet, it is known to attach a shroud. The shroud is provided with a connection interface, to which compatible equipment can be securely attached.

An object of the present invention may be to provide a helmet attachment system that provides advantages compared to the known solutions in the art.

Another object may be to provide a helmet attachment system that reduces the risk of unintentional removal (loss) of attached equipment.

Furthermore, an object may be to provide a helmet attachment system that is less exposed to wear during use.

Other possible objects will appear from the discussion below, where various advantageous features are presented.

SUMMARY OF INVENTION

According to a first aspect of the invention, there is provided a helmet attachment arrangement that has a base layer and an attachment layer. The attachment layer is attached on one face of the base layer. The attachment layer comprises a plurality of attachment layer sections that have a mutual distance and that together define a string-receiving pattern.

As will become apparent from the description of the helmet attachment arrangement herein, the helmet attachment arrangement can be attached between the main body of a helmet and a net attached to the main body.

According to an embodiment of the invention, the string-receiving pattern comprises at least three pattern ports, through which strings of a net can enter and exit the string-receiving pattern. In some embodiments the string-receiving pattern can have four pattern ports.

Advantageously, the attachment layer can comprise a part of a hook-and-loop attachment system. Such a hook-and-loop system is typically known and referred to as Velcro. Other attachment systems can however also be used, for instance snap buttons (typically used with raincoats and the like).

In some advantageous embodiments, the string-receiving pattern can be a strip-receiving pattern. It will then be configured to receive strips of a sheet net. The strips of a sheet net will exhibit a flat configuration with two opposite and parallel faces. Such a sheet net will be discussed in further detail below.

The helmet attachment arrangement can comprise a flat portion configured to follow an external face of a helmet. Moreover, it can further comprise auxiliary attachment means that extend out from the flat portion.

Typically, the auxiliary attachment means can be extensions of the attachment layer sections, which can be bent up/curve up from the shape of the flat portion and which can be folded around a piece of equipment. Advantageously, the auxiliary attachment means can also comprise a hook-and-loop system, a strap buckle, snap buttons, or other suitable attachment means that can attach two or more auxiliary attachment means together.

According to a second aspect of the present invention, there is provided a helmet having a helmet main body. The main body has a helmet edge that defines an aperture for reception of a user's head. The helmet further has a net that extends over or along the external surface of the main body. The net comprises strings that completely encircles net apertures.

In some embodiments, the net comprises less than 60, 40, or even less than 30 fully encircled net apertures. In some embodiments, the net comprises even less than 20 net apertures that are fully encircled by the net strings. Along the periphery of the net, there can advantageously be strings having free ends, which are attached to the helmet main body.

In some embodiments of the helmet according to the invention, the main body can be made of an anti-ballistic material. Such an anti-ballistic material can advantageously comprise a fiber-reinforced composite. Such a composite can in preferred embodiments be cured or consolidated during production of the helmet main body.

In some embodiments, the net can be a sheet net, which is made of a sheet material from which said net apertures are cut.

With the term sheet net is meant a net having strings in the form of strips that have a flat configuration, meaning that they have a parallel and substantially flat upper and lower face. Moreover, the width of the strips will be larger than their height. Advantageously, the ratio between the width and the height of the strips can be at least 2:1, or even more preferably at least 4:1 or even 8:1.

In some embodiments, the helmet edge can be provided with an edge band that has a plurality of recesses. Furthermore, the net can comprise a plurality of free strings, the ends of which are attached to the helmet main body.

Preferably, the free strings can be attached to the helmet main body by means of attachment clamps.

Furthermore, the attachment clamps can in some embodiments be at least partially arranged in the recesses of the edge band.

In some embodiments of the helmet according to the invention, the attachment screws can extend through an attachment aperture that extends through the main body (i.e. through the wall of the main body). The attachment clamps, which fasten free strings of the net to the main body, can be attached by the attachment screws.

The net can in some embodiments be a sheet net. In such embodiments the attachment apertures can comprise strip-receiving apertures that have a straight edge against which the free strips of the net abut.

Advantageously, the edge band further has inner recesses that are arranged on the internal side of the main body. Preferably, the free strings or free strips of the net extend through the attachment apertures, and are clamped to the main body both by the attachment clamp and by an additional clamp, such as a counter screw head, on the opposite (i.e. inner) side of the main body.

The said strip-receiving apertures can advantageously have a shape similar to the Greek capitol letter omega, i.e. like a circular aperture combined with a slit-shaped aperture at the periphery of the circular aperture.

The helmet can in some embodiments have an edge band that comprises a wear indication means.

The wear indication means can for instance comprise a wear indicator layer embedded in the edge band, behind a wear layer. In other embodiments, the wear indication means can include a wear groove.

Advantageously, in embodiments where the wear indication means comprises a wear groove, there may be several wear grooves divided by wear ribs.

In some embodiments, the helmet can have a front attachment means that is attached to the front part of the main body by means of at least three screws. One screw can be an upper screw and two screws can be lower screws. According to such an embodiment, the two lower screws can be arranged at least partly in a recess of an edge band arranged to the helmet edge.

In this way, since the two lower screws for connection of the front attachment means (typically referred to as a shroud) can be the same as two of the attachment screws used to attach the net, one only needs one additional screw to attach it with three screws.

In some embodiments of the helmet, the net can be attached to the main body by means of attachment screws, and one or more wire attachment clips can be connected to the internal face of the main body by means of threaded nuts, by means of the heads of counter screws, or by means of discs.

In embodiments where a disc is used to attach the wire attachment clip, the disc can typically be retained in place by means of a nut or counter screw that engages with the attachment screw.

According to a third aspect of the present invention, there is provided a helmet attachment system that comprises a helmet, a net arranged on the helmet, and a helmet attachment arrangement as presented above and in one or more of the appending claims.

DETAILED DESCRIPTION OF THE INVENTION

While several advantageous and possible features of the invention have been presented above, some non-limiting and more detailed examples of embodiment will be presented in the following with reference to the drawings, in which FIG. 1*a* to FIG. 1*d* show perspective views of various embodiments a ballistic helmet;

Figure 18:
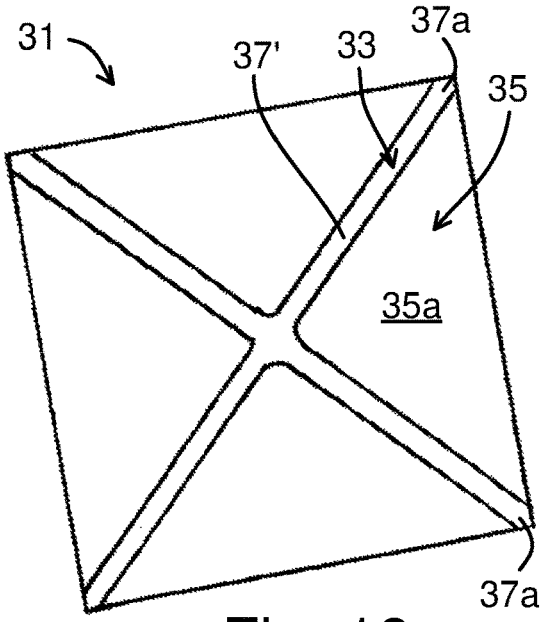
Figure 19:
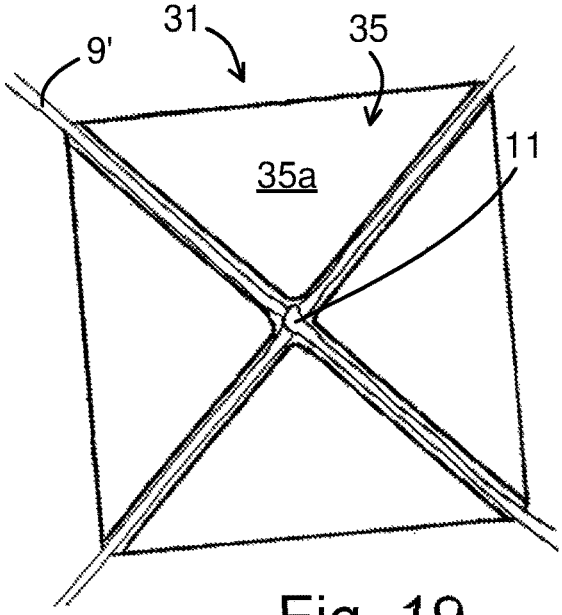
Figure 16:
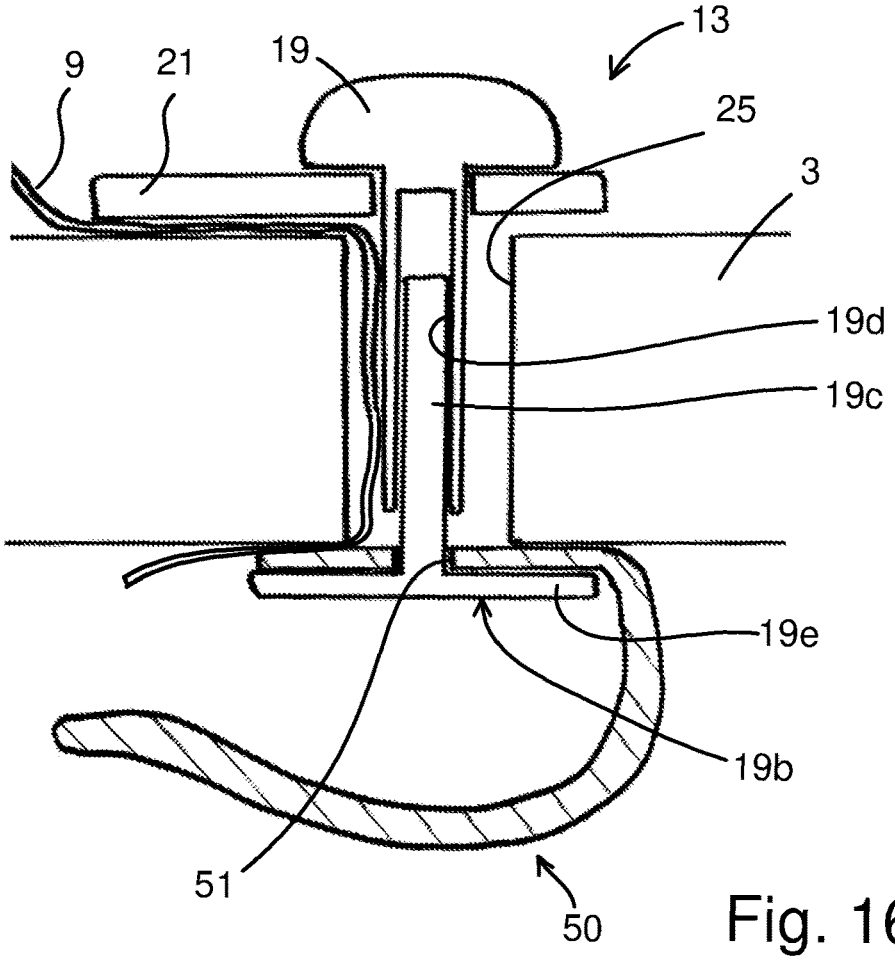
Figure 17:
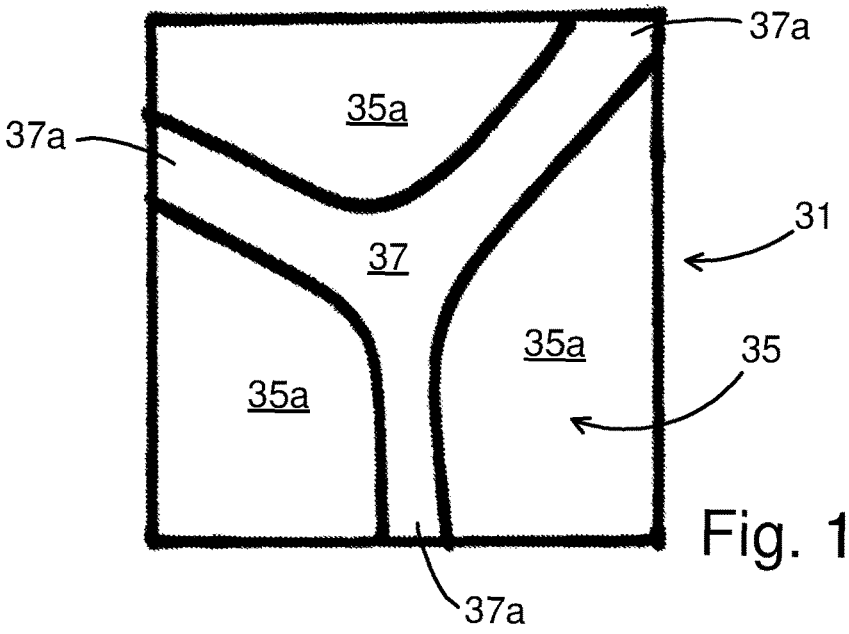
Figure 20:
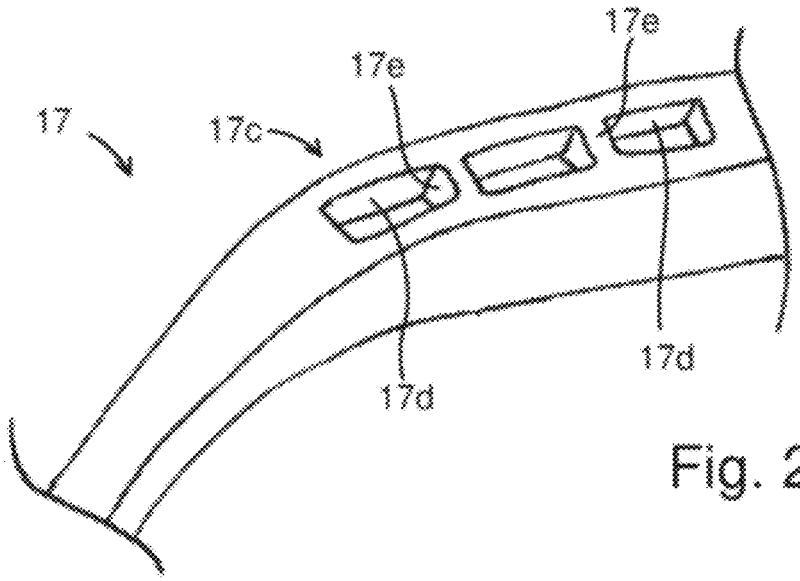
Figure 21:
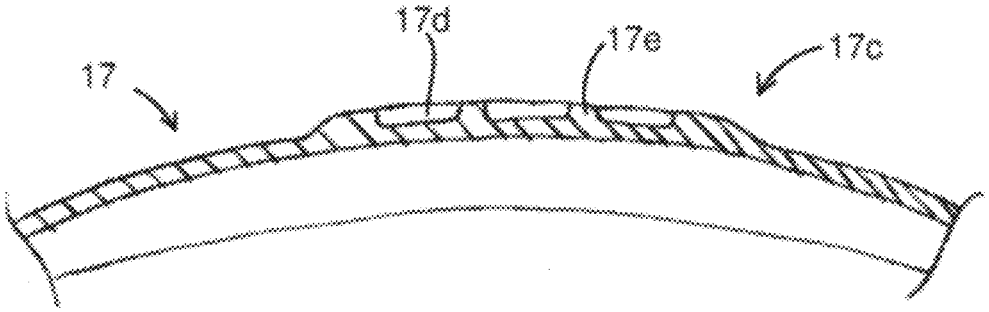
Figure 22:
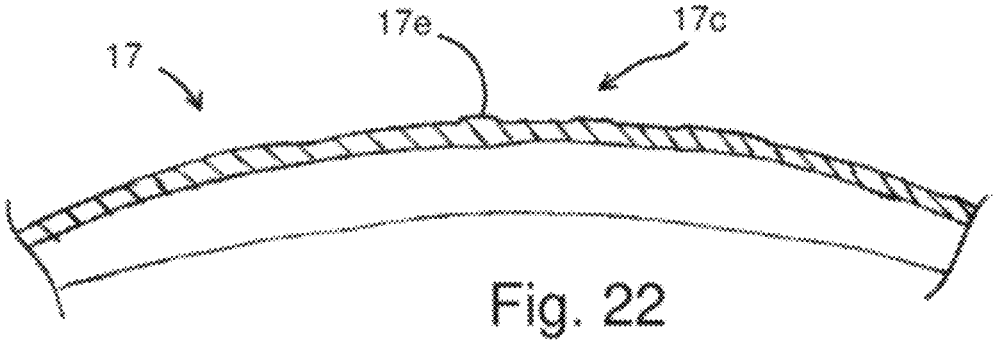

FIG. 16 an enlarged cross section view showing an attachment section;

FIG. 17 is a schematic top view of another embodiment of an attachment arrangement;

FIG. 18 is a schematic top view of yet another embodiment of an attachment arrangement;

FIG. 19 is a schematic top view showing the attachment arrangement of FIG. 18 in an attached state;

FIG. 20 shows a principle perspective view of a portion of an edge band having a wear indication means;

FIG. 21 is a principle cross section view through the edge band shown in FIG. 20; and FIG. 22 is a principle cross section view through the edge band shown in FIG. 20, after considerable wear.

FIG. 1*a* to FIG. 1*d* depict various helmets 1. In these example embodiments, the helmet 1 is a ballistic helmet. The skilled person will however appreciate that the discussed features also can be used on other types of helmets.

Figure 1A:
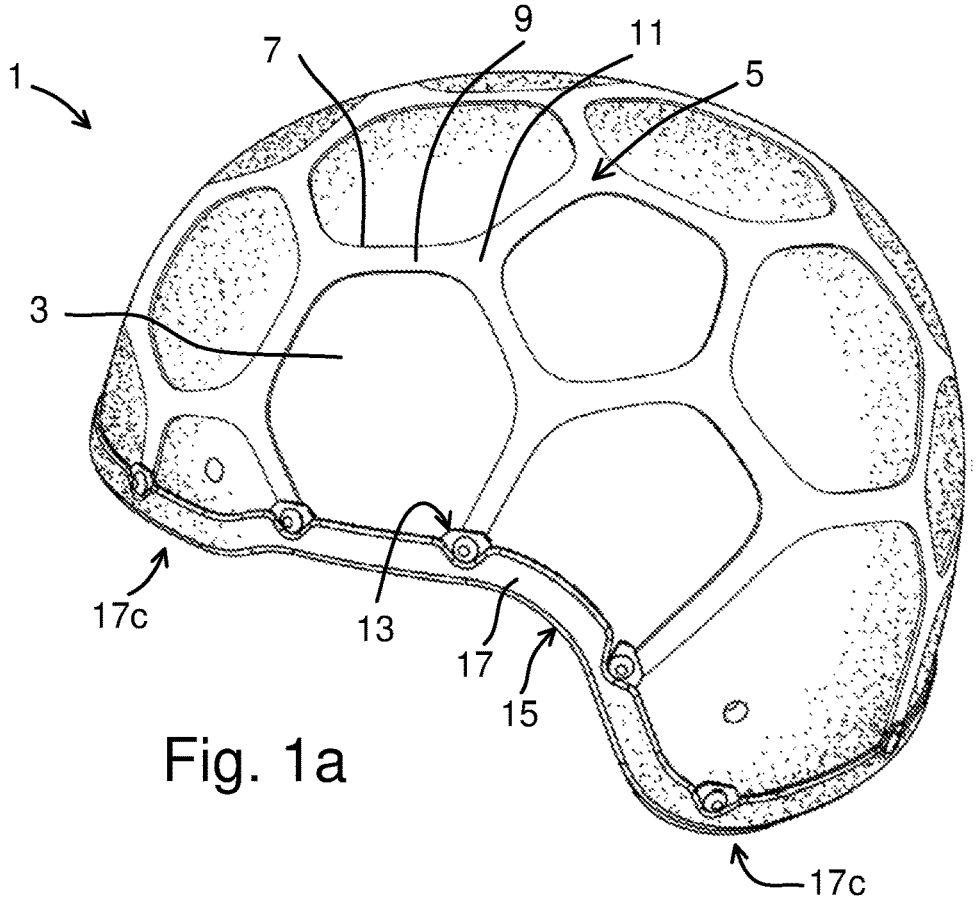

Referring to FIG. 1*a*, the helmet 1 has a main body 3 that is made of an anti-ballistic material. Advantageously, the main body 3 can be made of a consolidated/cured fiber-reinforced composite material.

Onto the main body 3 there is arranged a net 5. In the shown embodiment, the net is in the form of a sheet net 5, as the net is made of a sheet material. Other embodiments may involve another type of net, such as a net made of strings, strands or cords.

Advantageously, the sheet net 5 can be made of a sheet material from which apertures 7 are cut, such as by laser cutting, punching or other methods.

The sheet net 5 comprises said net apertures 7, which are at least partially defined by strips 9. Some of the net apertures 7 are completely defined (encircled) by the strips 9. The strips 9 extend between strip junctions 11. Some strips 9 extend between a strip junction 11 and an attachment section 13.

In the embodiment shown in FIG. 1*a*, all the strip junctions 11 comprises three strips 9 extending out from the strip junctions 11. In the embodiment shown in FIG. 1*c*, some strip junctions 11 have four strips, while other junctions have three. In further embodiments, strip junctions 11 can have even more strips 9.

As any common helmet, the helmet main body 3 comprises a helmet opening configured for receiving the head of a user. The helmet opening is defined by a helmet edge 15. Attached to the helmet edge 15, there is an edge band 17, which in the shown embodiments is a continuous list that extends along the entire helmet edge 15. As shown with FIG. 1*a* to FIG. 1*d*, the sheet net 5 is attached to the main body 3 of the helmet 1 along the extension of the edge band 17. At the attachment sections 13, the free ends of the peripheral strips 9 are attached. In this embodiment, the free ends of the peripheral strips 9 are attached with a screw and clamp arrangement.

Figure 2:
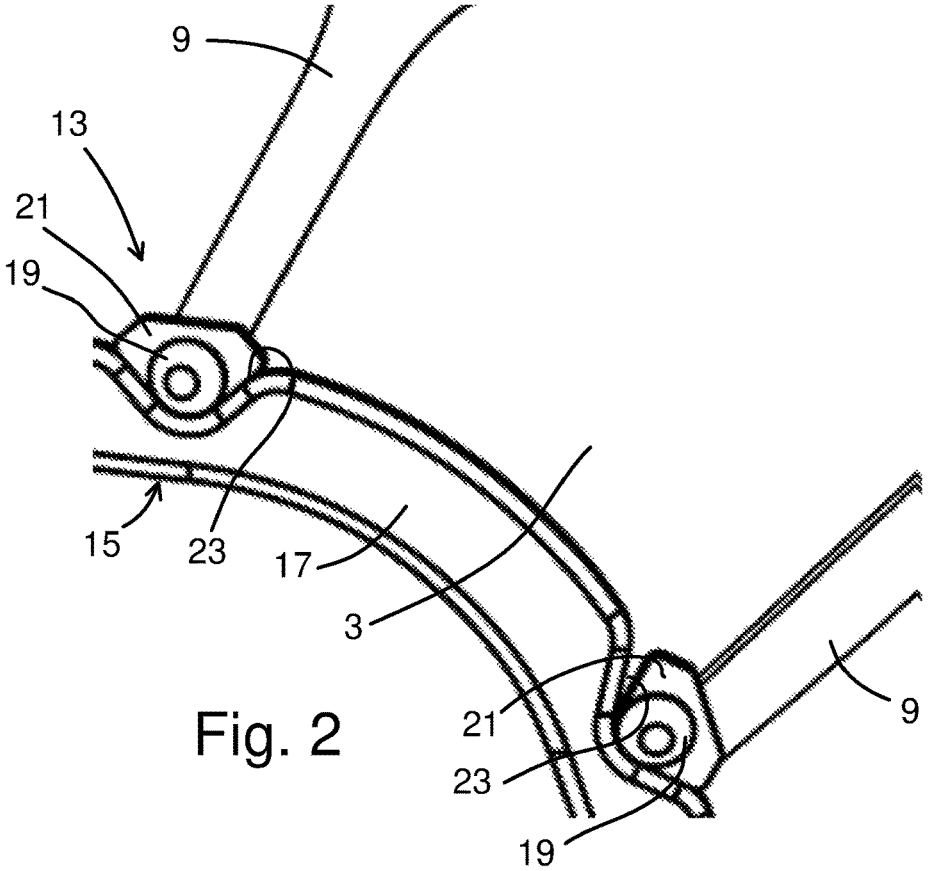
FIG. 2 is an enlarged view of an edge-portion of a helmet.

FIG. 2 depict an enlarged portion of the helmet 1 along a portion of the helmet edge 15. The head of an attachment screw 19 and an attachment clamp 21 is shown.

Also shown in FIG. 2, the edge band 17 comprises a plurality of recesses 23 that receives the attachment clamps 21. The recesses 23 contributes in preventing the attachment sections 13 from getting entangled. The recesses 23 also provide some protection for the attachment sections 13, such as from impacts that may affect the attachment function.

By fastening the sheet net 5 immediately adjacent the edge band 17, the sheet net 5 covers substantially the entire external face of the main body 3 (except for the exposed areas in the net apertures of course). Furthermore, one avoids extending the sheet net 5 around the helmet edge 15, where the sheet net 5 would be exposed to substantial wear.

Figure 3:
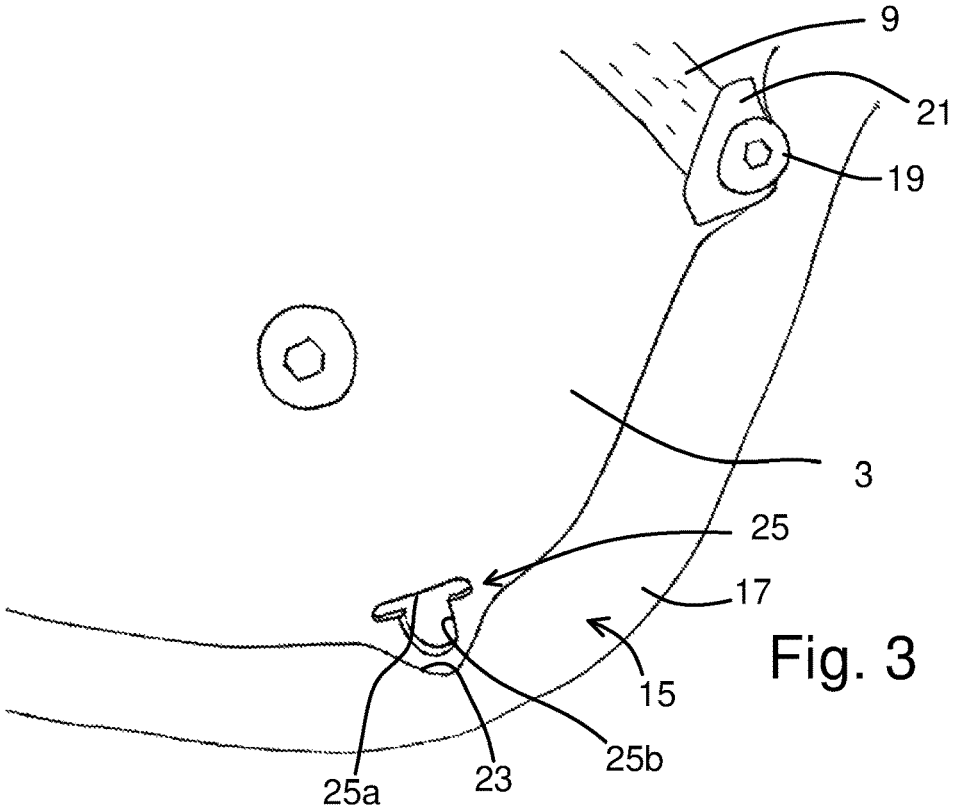
FIG. 3 is another enlarged view of an edge-portion of a helmet.

FIG. 3 shows another enlarged portion of the helmet main body 3 along a portion of the helmet edge 15. For illustrational purpose, a strip 9, the attachment screw 19 and the attachment clamp 21 have been removed, making an attachment aperture 25 visible.

Figure 4:
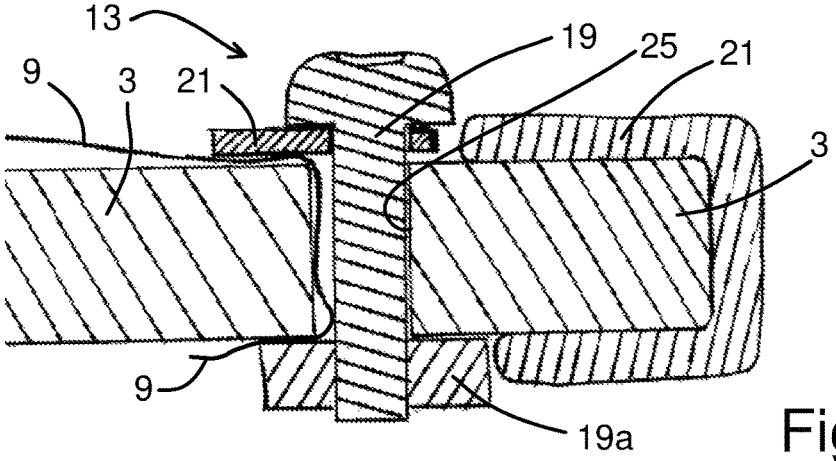
FIG. 4 is a principle, enlarged cross section view of an edge-portion.

The function of the attachment screw 19 and the attachment clamp 21 is shown in FIG. 4. FIG. 4 is an enlarged principle cross section through a portion of the main body 3 along the helmet edge 15, and through an attachment aperture 25. As shown, the attachment screw 19 extends through the attachment aperture 25 and is fastened with a threaded nut 19*a* in a conventional manner. As will be shown further below, other attachment solutions are also possible.

The strip 9 is clamped between the attachment clamp 21 and the helmet main body 3, when the attachment screw 19 is tightened with the attachment nut 19*a*.

As shown in FIG. 3, the attachment aperture 25 comprises a strip-receiving section 25*a* and a screw-receiving section 25*b*. As shown, the strip-receiving section 25*a* and the screw-receiving section 25*b* together form one single aperture. In other embodiments, however, it is possible to form the strip-receiving section 25*a* and the screw-receiving section 25*b* are two distinct, adjacent apertures. Advantageously, the strip-receiving section 25*a* comprises a substantially straight edge, against which the strip 9 abuts when in a fastened stated.

Referring again to FIG. 4, the cross-section of the edge band 17 has a generally U-shaped form. The U-form constitutes a channel in which the edge of the main body 3 is received.

The U-shape thus has two parallel walls. The recesses 23 discussed above are in one of these parallel walls.

Figure 5:
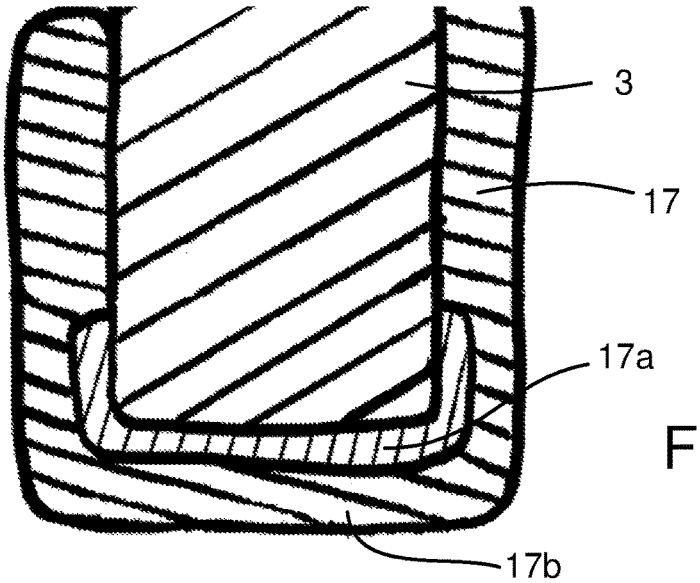
FIG. 5 is another principle, enlarged cross section view of an edge portion.

FIG. 5 depicts another cross-section through an edge portion of the main body 3, showing again how the edge of the main body 3 is received in the edge band 17. In addition, FIG. 5 shows a wear indication means in the form of a wear indicator layer 17*a* that is a part of the edge band 17. The wear indicator layer 17*a* has another colour than the rest of the edge band 17. A wear layer 17*b* is arranged on the external side of the edge band 17, with respect to the wear indicator layer 17*a*. Advantageously, the wear layer 17*a* is of the same material as the other parts of the edge band 17, except for the wear indicator layer 17*a*. When the wear layer 17*b* is worn away, after use of the ballistic helmet 1, the wear indicator layer 17*a* becomes visible. Thus, the user will be able to tell that the ballistic helmet 1 has been used for some time.

It will be understood by the person of skill, that the wear indicator layer 17*a* and the wear layer 17*b* may be of the same material, however having a different colour to enable the wear indicating function.

Another embodiment of a wear indication means will be discussed further below with reference to FIG. 20 to FIG. 22.

Figure 1B:
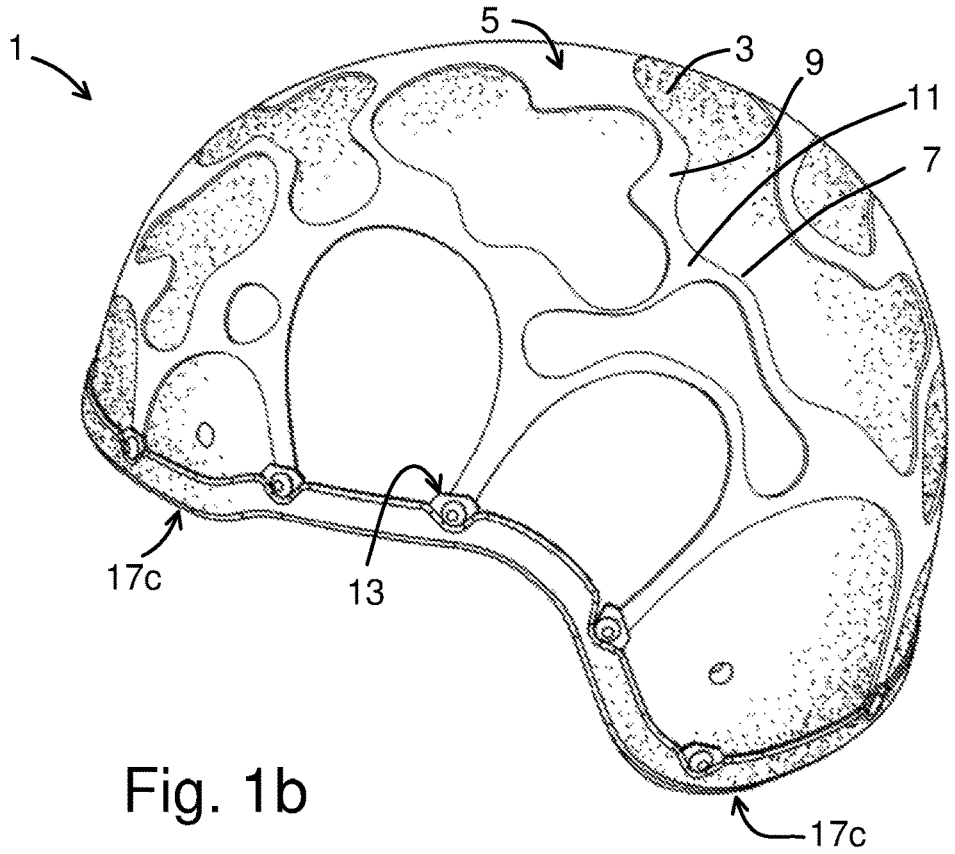
Figure 1C:
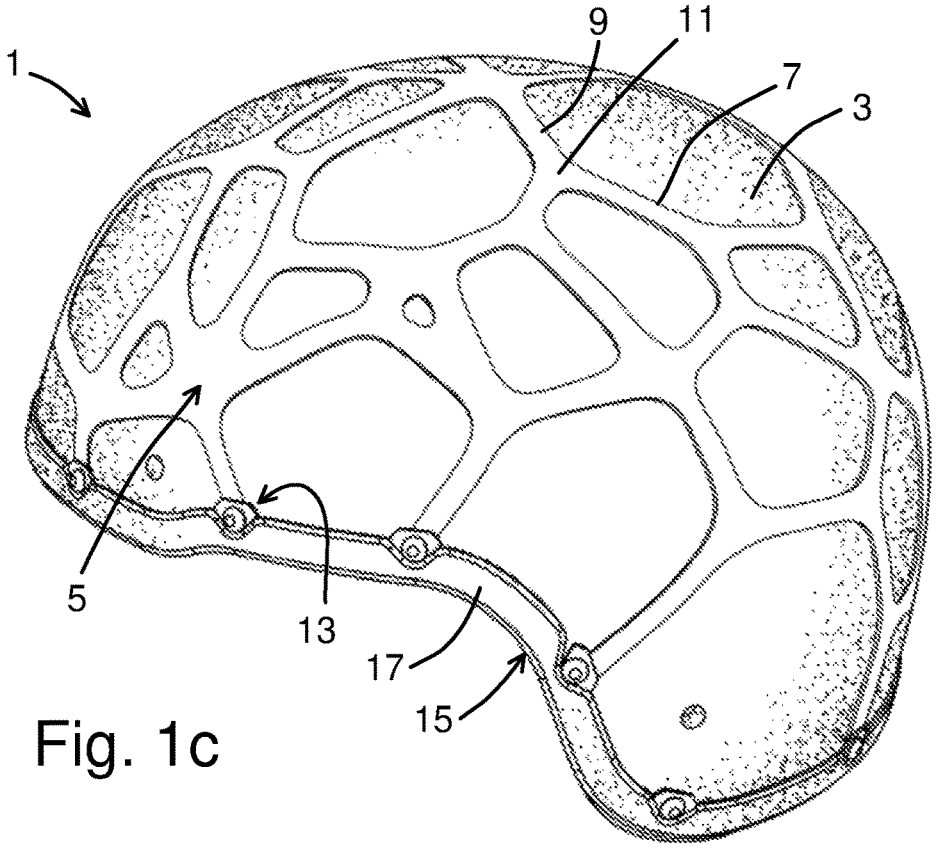
Figure 1D:
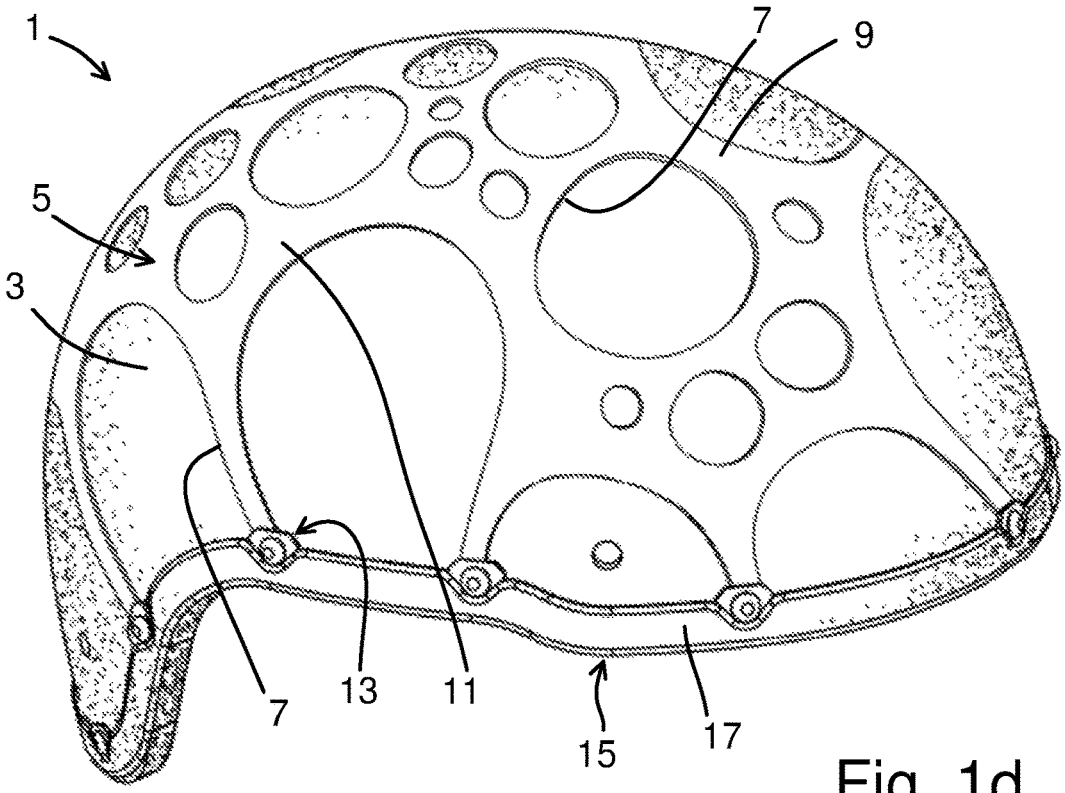

In FIG. 1*a* and FIG. 1*b*, there is indicated two wear-exposed portions 17*c* of the edge band 17, where the wear indicator layer 17*a* may be integrated in the edge band 17.

A particular advantage with the wear indicator layer 17*a*, is that by enabling indication of wear of the ballistic helmet 1, one can avoid that the edge of the main body 3 is exposed to water or other contaminants. Such contaminants could in some embodiments enter into the anti-ballistic material of the main body 3, and thus possibly reduce its anti-ballistic function.

The edge band 17 can be attached to the helmet main body 3 by any suitable means, for instance with an adhesive.

In the following, some example embodiments of a novel helmet attachment system will be presented.

Figure 6:
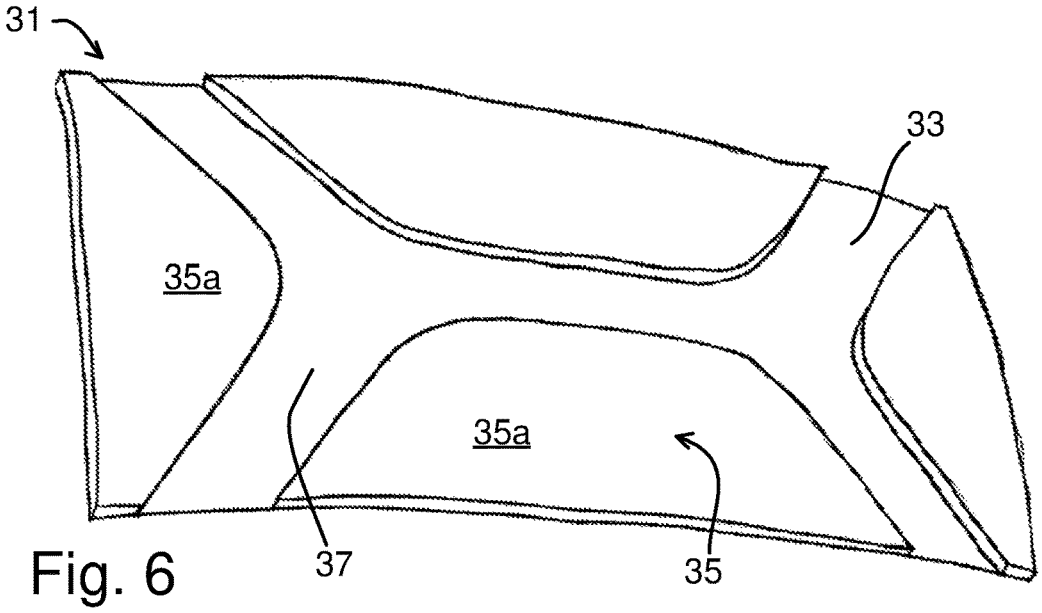
FIG. 6 is a perspective view of an attachment arrangement according to the invention.

FIG. 6 depicts a helmet attachment arrangement 31 with a perspective view. The helmet attachment arrangement 31 has the form of a patch. The attachment arrangement 31 has a base layer 33. The base layer 33 can advantageously be made of a fabric, which makes the attachment arrangement 31 flexible. Attached to the base layer 33 there is an attachment layer 35. As shown in FIG. 6, due to the thickness of the attachment layer 35, the upper face of the attachment layer 35 is elevated with respect to the upper face of the base layer 33.

In the embodiment shown in FIG. 6, there are four attachment layer sections 35*a*. The attachment layer sections 35*a* are arranged on the base layer 33 with a mutual distance to each other, thereby forming a pattern. The pattern between the attachment layer sections 35*a* is a string-receiving pattern 37. The string-receiving pattern 37 is configured to receive strings or strips 9 of the sheet net 5 (cf. FIG. 1*a*) when the attachment arrangement 31 is interposed between the helmet main body 3 and the sheet net 5. This is shown with the perspective view of FIG. 8. As the string-receiving pattern 37 in this embodiment is configured to receive strips 9 of the net 5, which is a sheet net 5, it may be termed a strip-receiving pattern 37.

Figure 7:
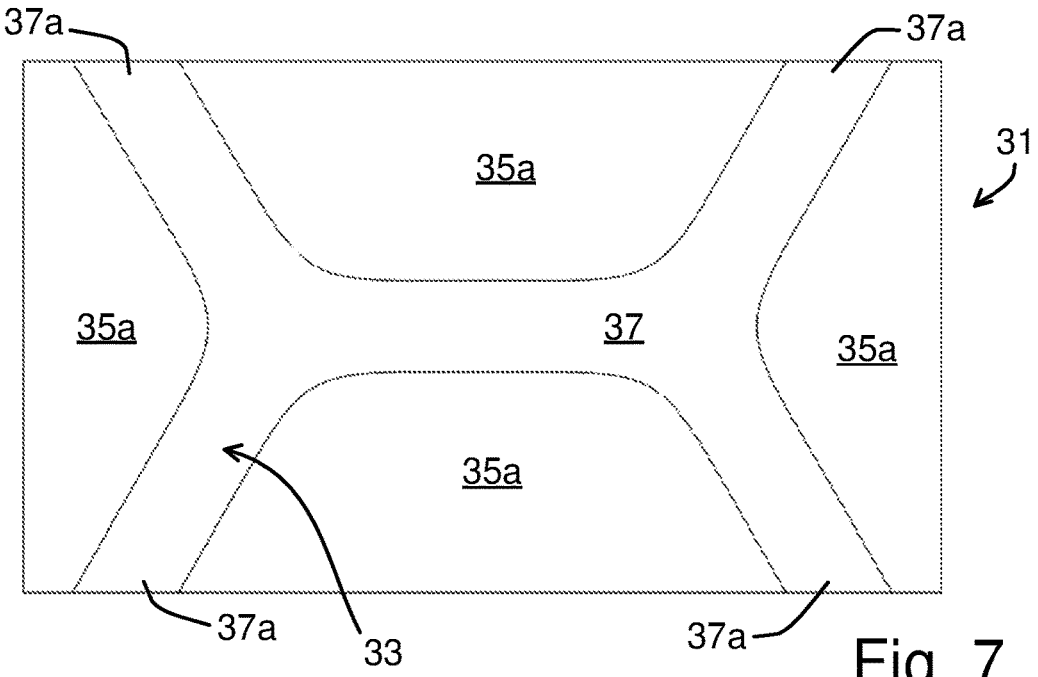
FIG. 7 is a top view of the attachment arrangement shown in FIG. 6.

FIG. 7 is a top view of the helmet attachment arrangement 31. In this embodiment, the strip-receiving pattern 37 is configured to receive two strip junctions 11 that each connects three strips 9. The two strip junctions 11 are interconnected with a common strip 9. Four strips exit the strip-receiving pattern 37 through four pattern ports 37*a*.

Figure 8:
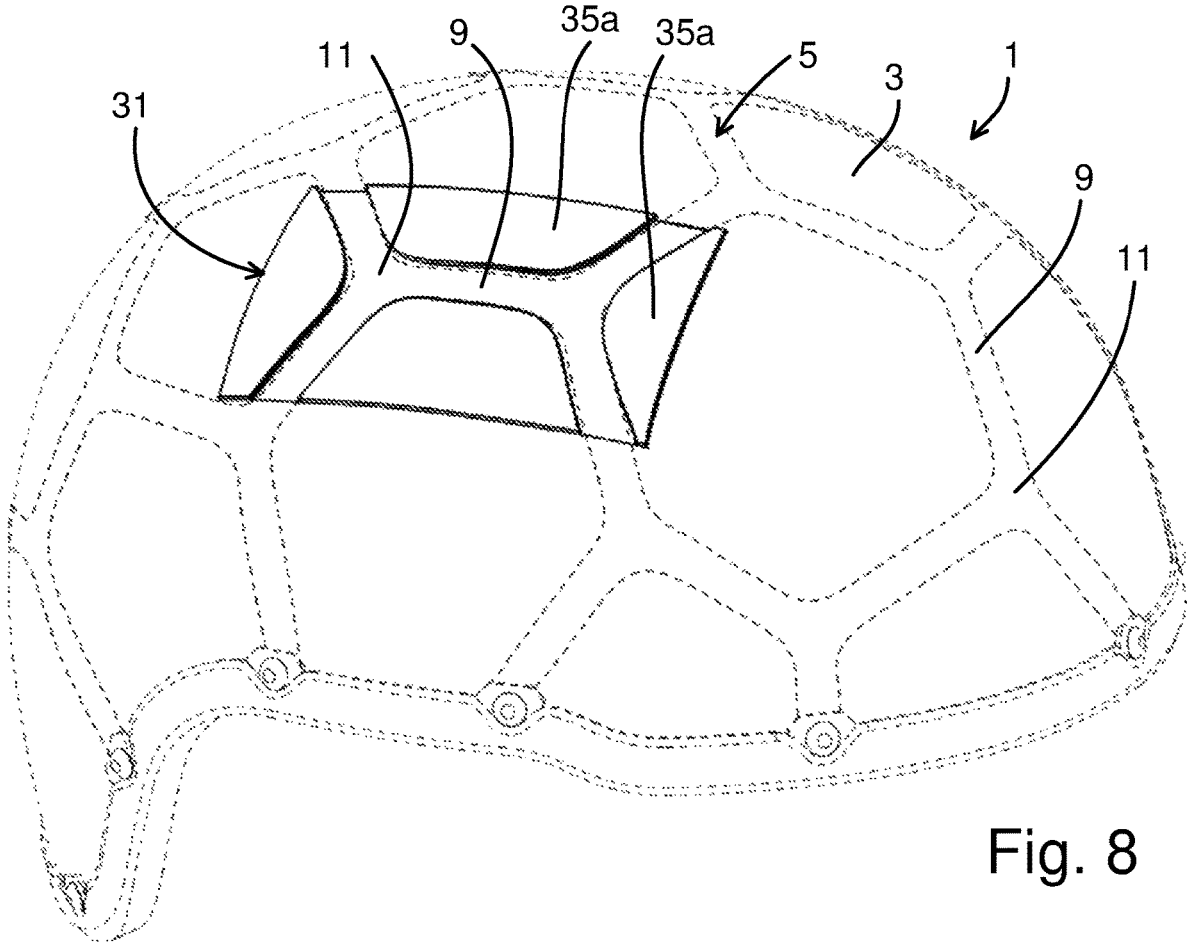
FIG. 8 is a perspective view of the attachment arrangement shown in FIG. 6, when attached to a ballistic helmet.

FIG. 8 shows the helmet attachment arrangement 31 when placed between the helmet main body 3 and the sheet net 5, with the strip-receiving pattern 37 aligned with the sheet net 5. The engagement between the edges of the attachment layer sections 35*a*, which define the strip-receiving pattern 37, and the sheet net 5, will secure the attachment arrangement 31 to the ballistic helmet 1.

Advantageously, the upper face of the attachment layer 35 can comprise one part of a hook-and-loop system, such as the system often referred to as Velcro. In such embodiments, equipment that shall be attached to the ballistic helmet 1 can be fastened simply by placing the equipment onto the attachment arrangement 31 on the helmet (provided of course that the equipment is provided with a mating part of the hook-and-loop system).

In other embodiments, instead of or in addition to the hook-and-loop system, the attachment layer 35 can comprise other attachment means, for instance snap-buttons/snap fasteners.

In the embodiment discussed with reference to and shown in FIG. 6, FIG. 7 and FIG. 8, the entire attachment arrangement 31 had a substantially flat configuration when mounted to the ballistic helmet 1. Hence, the shown attachment arrangement 31 constitutes a flat portion 31*a*.

Figure 9:
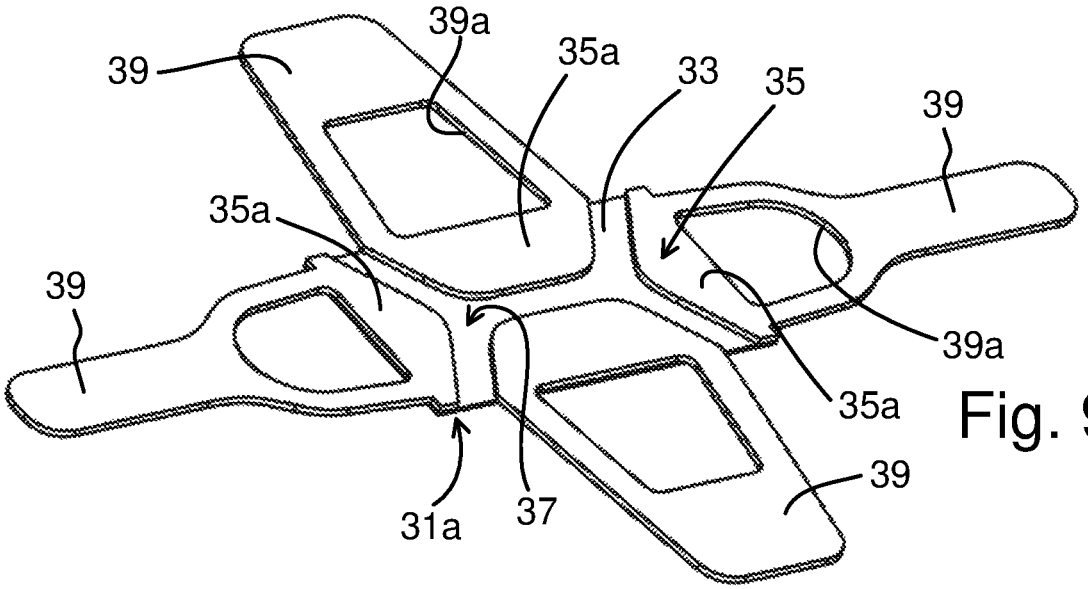
FIG. 9 is a perspective view of another embodiment of an attachment arrangement.

The attachment arrangement 31 depicted in FIG. 9, however, has a flat portion 31*a* and is further provided with auxiliary attachment means 39 that extend out from the flat portion 31*a*. In the embodiment shown in FIG. 9, the flat portion 31*a* corresponds to the attachment arrangement 31 shown in FIG. 6 to FIG. 8.

In the embodiment shown in FIG. 9, the auxiliary attachment means 39 are in the form of flexible attachment flaps. As appears from FIG. 9 and from FIG. 10, the auxiliary attachment means 39 are configured as extensions of the attachment layer sections 35*a* beyond the flat portion 31*a*.

Figure 11:
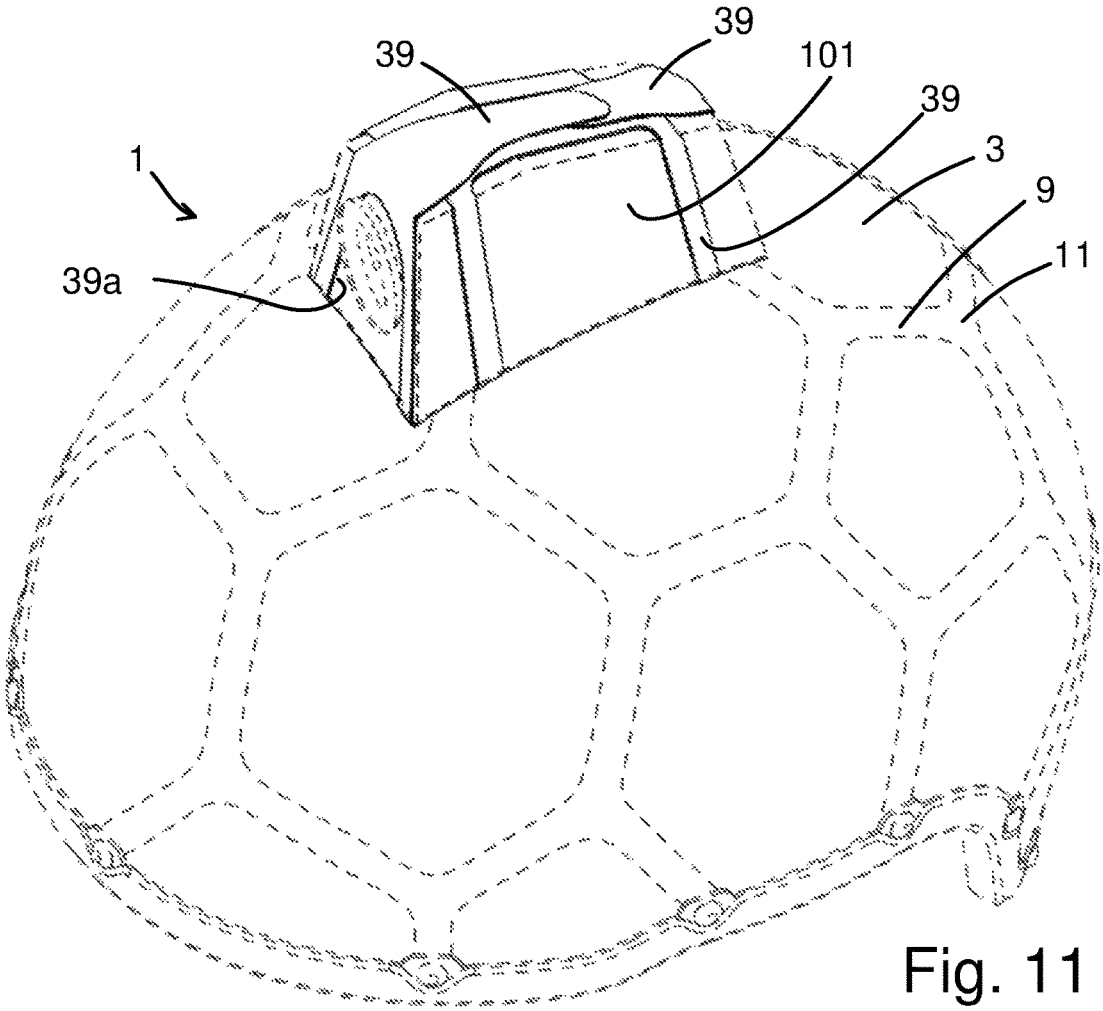
FIG. 11 is a perspective view showing a helmet-worn equipment secured with the attachment arrangement shown in FIG. 9 and FIG. 10.

The auxiliary attachment means 39 can be bent upwards from the surface of the helmet main body 3, to envelop a piece of equipment. This is shown in FIG. 11, where equipment 101 in the form of a portable light is attached to the helmet attachment arrangement 31. As will be understood, before attaching the portable equipment 101, the attachment arrangement 31 was attached to the ballistic helmet 1.

Figure 10:
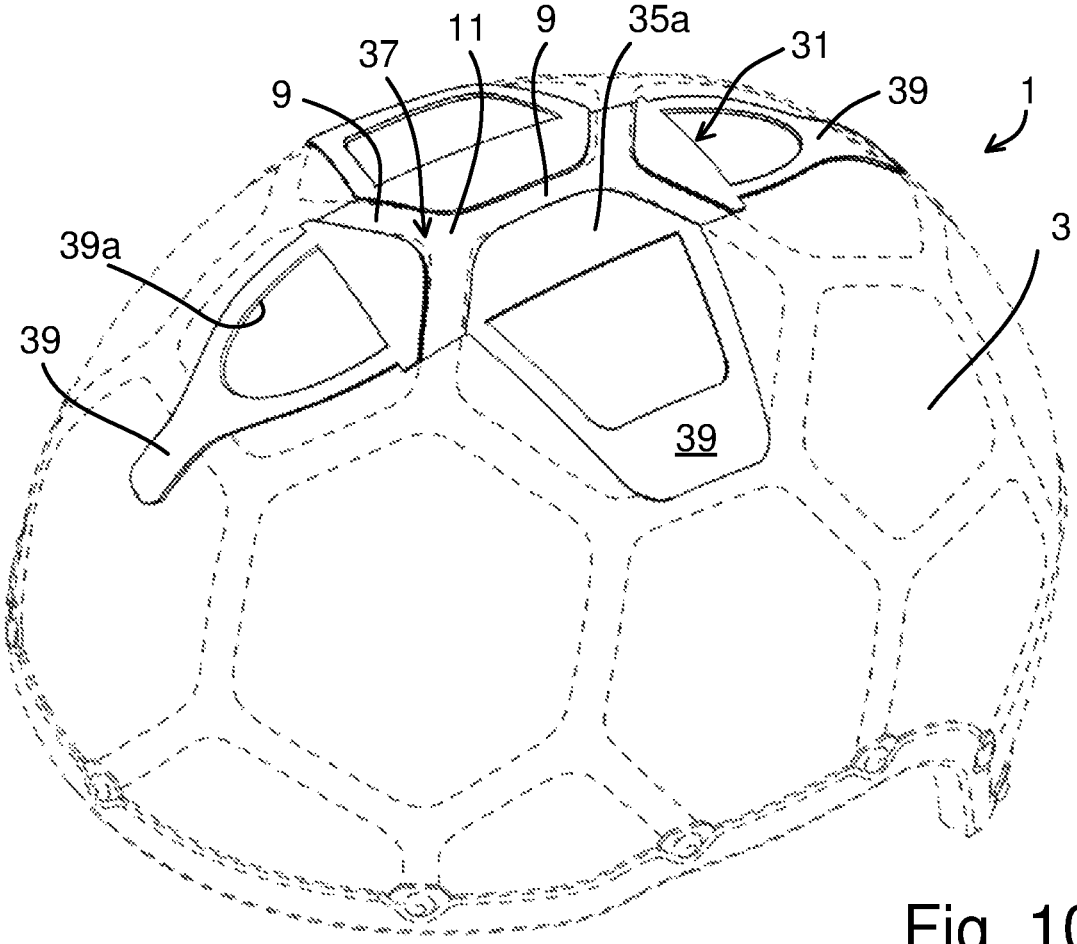
FIG. 10 shows the attachment arrangement according to FIG. 9 attached to a ballistic helmet.

In the embodiment shown in FIG. 9 to FIG. 11, the auxiliary attachment means 39 are also provided with a hook-and-loop system. Thus, opposite auxiliary attachment means 39, such as attachment flaps 39 provided on opposite sides of the flat portion 31*a*, can connect to each other when being folded over the portable equipment 101. Other solutions for connecting the auxiliary attachment means together can also be used, for instance a strap buckle or a strap snap-on clip.

The helmet attachment arrangement 31 having the auxiliary attachment means 39, may be provided with an equipment aperture 39*a* in the auxiliary attachment means 39. The equipment aperture 39*a* permits communication between the attached equipment 101 and the ambience. For instance, if the equipment is in form of a camera, the camera can capture images through the opening provided by the equipment aperture 39*a*. Similarly, if the equipment 101 is a lighting device, light can be emitted through the equipment aperture 39*a*.

Figure 12:
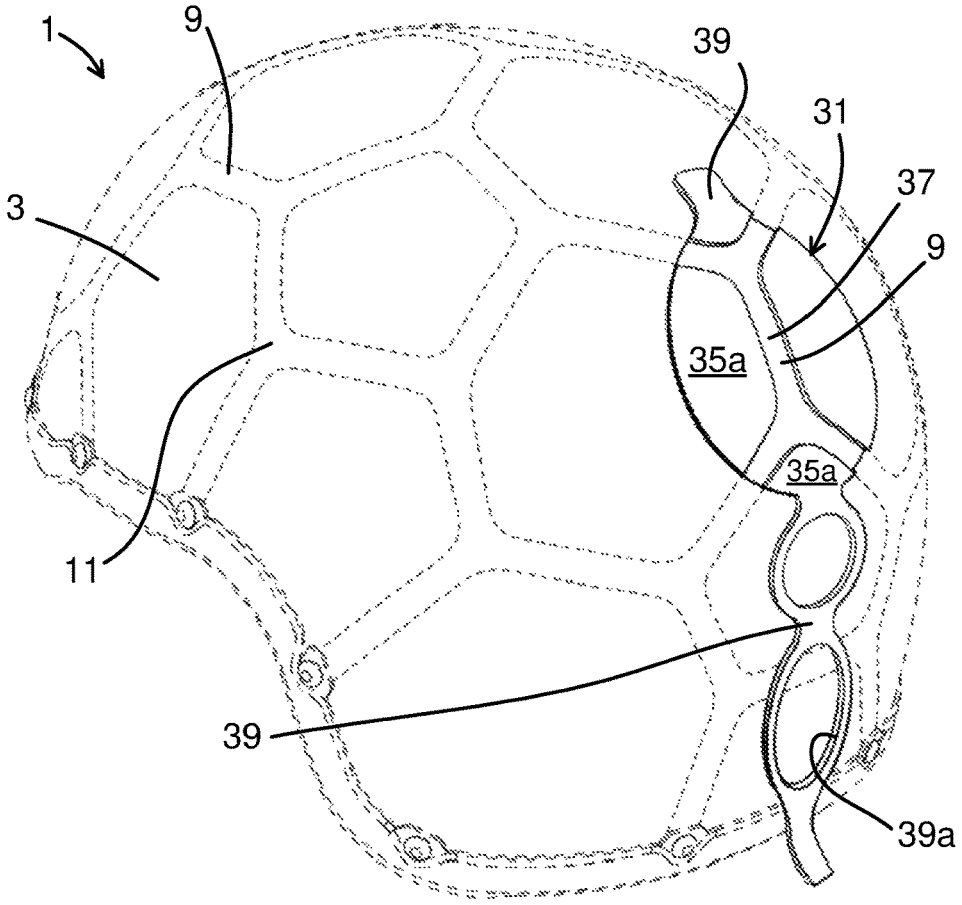
FIG. 12 is a perspective view showing another embodiment of an attachment arrangement, when secured to a ballistic helmet.
Figure 13:
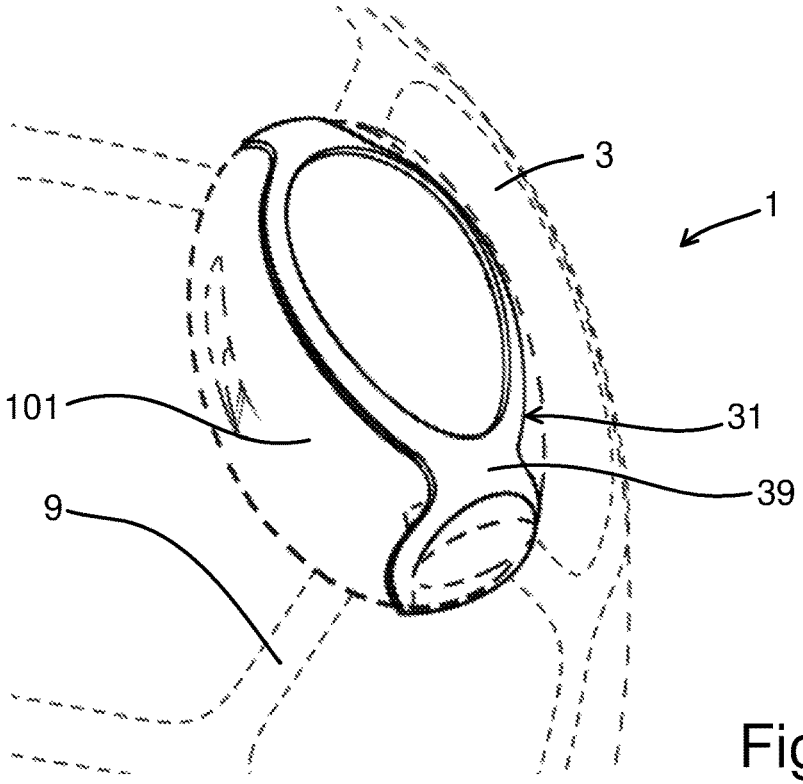
FIG. 13 shows a helmet-worn equipment secured to a ballistic helmet with the attachment arrangement shown in FIG. 12.

FIG. 12 and FIG. 13 shows another embodiment of a helmet attachment arrangement 31 that has auxiliary attachment means 39. In this embodiment, two of the four attachment layer sections 35*a* are extended with auxiliary attachment means 39, while the other two attachment layer sections 35 are arranged within the flat portion 31*a*.

Figure 14:
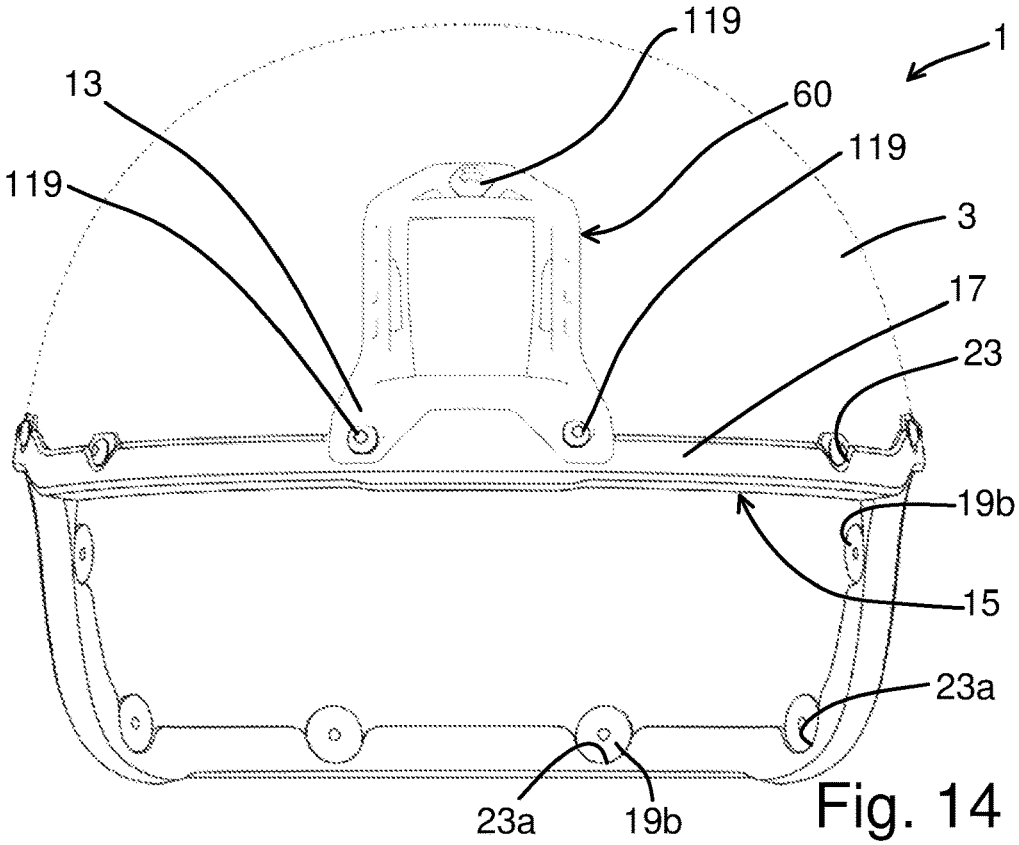
FIG. 14 is a front view of a ballistic helmet having a front attachment means.
Figure 15:
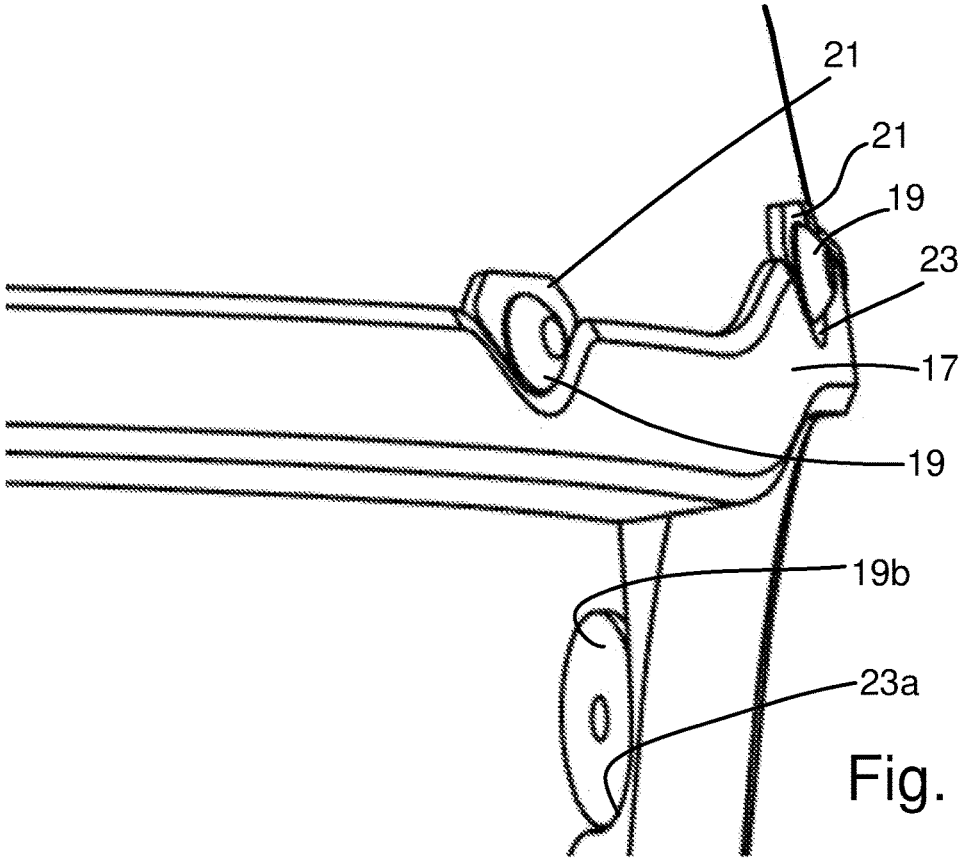
FIG. 15 is an enlarged portion of FIG. 14.

FIG. 14 depicts the helmet 1 with a front view, however without the sheet net 5. FIG. 15 shows an enlarged portion of FIG. 14.

In advantageous embodiments, such as shown in FIG. 14, the edge band 17 is an endless list extending along the entire helmet edge 15 of the main body 3. Notably, the edge band 17 is not attached to the helmet main body 3 by means of the attachment screws 19. Rather, the attachment screws 19 are used to attach the sheet net 5.

In the embodiment shown in FIG. 14 and FIG. 15, the attachment screws 19 are fastened by means of a counter screw 19*b*. The function of the counter screw 19*b* will be discussed below, with reference to FIG. 16. FIG. 15 shows particularly well how the recesses 23 of the edge band 17 protects the attachment clamp 21, as it is at least to some degree recessed in the recess 23. Also shown in FIG. 14 and FIG. 15, the edge band 17 is further provided with inner recesses 23*a* arranged on the inside face of the helmet main body 3. As appears from FIG. 15, the counter screws 19*b* are recessed in the inner recesses 23*a*, and are thus also protected from impacts and entanglement.

FIG. 16 is an enlarged cross-section view similar to the cross-section view of FIG. 4. As appears from FIG. 16, instead of being fastened with the threaded nut 19*a*, the attachment screw 19 is fastened with a counter screw 19*b*. The counter screw 19*b* has a threaded stem 19*c* that enters a threaded bore 19*d* of the attachment screw 19. The threaded stem 19 protrudes from a counter screw head 19*e*. As with the embodiment shown in FIG. 4, the strip 9 is clamped against the helmet main body 3, thereby being securely attached. The strip 9 is clamped against the helmet main body 3 both by the head of the attachment screw 19 and by the counter screw head 19*e*.

Still referring to FIG. 16, a wire attachment clip 50 is connected to the ballistic helmet 1 by means of the counter screw 19*b*. In particular, the wire attachment clip 50 is clamped against the inner face of the helmet main body 3, between the main body 3 and the counter screw head 19*e*. The wire attachment clip 50 has an attachment clip aperture 51, through which the threaded stem 19*c* of the counter screw 19*b* extends.

The wire attachment clip 50 is thus arranged on the inner face of the main body 3, and is configured to removably secure a wire, such as a communication wire or a power supply to equipment attached to the ballistic helmet 1.

It will be appreciated that along the helmet edge 15, there are additional attachment sections 13 corresponding to the one shown in FIG. 16, however without the wire attachment clip 50.

FIG. 17 depicts an alternative helmet attachment arrangement 31. In this embodiment, the strip-receiving pattern 37 is configured to receive one strip junction 11 that connects three strips 9. Thus, the strip-receiving pattern 37 exhibits three pattern ports 37*a*.

FIG. 18 and FIG. 19 depict yet another alternative helmet attachment arrangement 31. This attachment arrangement 31 is configured to engage with a net 5 that is not a sheet net as shown and discussed above. Rather, the attachment arrangement 31 shown in FIG. 18 and FIG. 19 has a string-receiving pattern 37' that is configured to receive strings 9' of a net 5 that is made of strings, cords or the like, i.e. not a sheet material. Such strings 9' are shown in FIG. 19, arranged in the string-receiving pattern 37' of the attachment arrangement 31.

It is again referred to FIG. 14, which depicts a ballistic helmet 1 shown without the net 5. Attached to the helmet main body 3 is a front attachment means 60, in the art commonly referred to as a shroud. The front attachment means 60 is used for attachment of helm-worn equipment that needs to be securely and removably attached to the helmet front portion. The front attachment means 60 is secured to the main body 3 by means of three screws 119. Advantageously, the screws 119 can be identical to the attachment screws 19 discussed above.

The attachment means 60 is attached with one upper screw 119 and two lower screws 119. Furthermore, the two lower screws 119 are arranged in two respective recesses 23 of the edge band 17.

Also shown in FIG. 14, the counter screws 19*b*, or the counter screw heads 19*e* in some embodiments, are arranged snugly in the inner recesses 23*a* of the edge band 17. In this manner, the counter screws 19*b* will contribute in withstanding impact forces on the edge band 17, as a force on the edge band 17 may be transferred to the counter screws 19*b*. This is because the counter screws 19*b* (or the counter screw heads 19*e* in some embodiments) abuts the edge band 17 at the inner recesses 23.

Reference is now made to FIG. 20, FIG. 21 and FIG. 22, which show another embodiment of a wear indication means 17*a*. FIG. 20 shows a portion of the edge band 17 at a wear-exposed portion 17*c*. The wear-exposed portion 17*c* comprises wear grooves 17*d*. The wear grooves 17*d* are separated by wear ribs 17*e*.

FIG. 21 depicts the wear-exposed portion 17*c* with a cross-section side view. As appears from FIG. 21, the thickness of the edge band 17 is thicker at the wear-exposed portion 17*c*, compared to the adjacent parts of the edge band.

FIG. 22 shows the same wear-exposed portion 17*c* as shown in FIG. 21, however after considerable wear. The wear ribs 17*e* are barely present since they have been worn down. This gives the user or owner an indication of the use of the helmet 1 onto which the edge band 17 is arranged.

The invention claimed is:

1. A helmet attachment system comprising:

a helmet;

a net arranged on an external surface of the helmet and accessible during use of the helmet by a user;

a helmet attachment arrangement;

wherein the helmet attachment arrangement comprises a base layer arranged on the external surface and an attachment layer adjacent to at least one portion of the net;

wherein the attachment layer is attached on one face of the base layer; and wherein the attachment layer comprises a plurality of attachment layer sections that have a mutual distance and that together define a string-receiving pattern configured to receive strings of the net.

2. The helmet attachment system according to claim 1, wherein the helmet attachment arrangement further comprises at least one of the plurality of attachment layer sections, a hook-and-loop system, a shroud, a strap buckle, a strap snap-on clip, a flexible attachment flap, a snap fastener, and a snap button.

3. The helmet attachment system according to claim 1, wherein the string-receiving pattern comprises at least three pattern ports, through which strings of a net can enter and exit the string-receiving pattern.

4. The helmet attachment system according to claim 1, wherein the attachment layer comprises a part of a hook-and-loop attachment system.

5. The helmet attachment system according to claim 1, wherein the string-receiving pattern is a strip-receiving pattern configured to receive strips of a sheet net.

6. The helmet attachment system according to claim 1, wherein the helmet attachment arrangement comprises a flat portion configured to follow an external face of the helmet, and that the helmet attachment arrangement further comprises auxiliary attachment means that extend out from the flat portion.

7. A helmet comprising:

a helmet main body having a helmet edge defining an aperture for receiving a user's head;

a net that extends over an external surface of the main body and is accessible during use of the helmet by a user;

wherein the net comprises strings that completely encircle apertures formed by the net; and wherein the net is a sheet net comprising a plurality of strips that have a flat configuration and define a plurality of apertures.

8. The helmet according to claim 7, wherein the helmet edge is provided with an edge band comprising a plurality of recesses;

the net comprises a plurality of free strings, which are attached to the helmet main body with attachment clamps; and that the attachment clamps are at least partially arranged in the recesses of the edge band.

9. The helmet according to claim 7, comprising:

attachment screws extending through an attachment aperture that extends through the main body, wherein attachment clamps that fasten free strings of the net are attached by the attachment screws.

10. The helmet according to claim 9, wherein the net is a sheet net and that the attachment apertures comprise strip-receiving apertures having a straight edge against which the free strips of the net abut.

11. The helmet according to claim 7, comprising an edge band and in that the edge band comprises a wear indication means.

12. The helmet according to claim 11, wherein the wear indication means comprises a wear indicator layer embedded in the edge band, behind a wear layer; or a wear groove.

13. The helmet according to claim 7, comprising a front attachment means that is attached to the front part of the main body by means of at least three screws, of which one screw is an upper screw and two screws are lower screws, wherein the two lower screws are arranged at least partly in a recess of an edge band arranged to the helmet edge.

14. The helmet according to claim 7, wherein the net is attached to the main body by means of attachment screws and in that a wire attachment clip is connected to the internal face of the main body by means of a threaded nut, by means of the head of a counter screw, or by means of a disc.

* * * * *